United States Patent [19]

Holck

[11] Patent Number: 4,631,757

[45] Date of Patent: Dec. 30, 1986

[54] METHOD FOR MANUFACTURING A PAIR OF BRIEFS AND BRIEFS MANUFACTURED ACCORDING TO THE METHOD

[76] Inventor: Claus Holck, Mellanvångsvågen 6 A, S-223 55 Lund, Sweden

[21] Appl. No.: 601,266

[22] Filed: Apr. 17, 1984

[30] Foreign Application Priority Data

Apr. 19, 1983 [SE] Sweden ..... 8302178

[51] Int. Cl.[4] ..... A41B 9/02; A41B 9/04

[52] U.S. Cl. ..... 2/402; 2/403; 2/406; 2/243 R

[58] Field of Search ..... 2/402, 400, 403, 406, 2/67, 243 R

[56] References Cited

U.S. PATENT DOCUMENTS

| | | | |
|---|---|---|---|
| 3,229,875 | 1/1966 | Stoller | 2/406 X |
| 3,245,407 | 4/1966 | Mason | 2/400 |
| 3,828,367 | 8/1974 | Bourgeois | 2/402 |

FOREIGN PATENT DOCUMENTS

| | | | |
|---|---|---|---|
| 792426 | 10/1935 | France | 2/403 |
| 962051 | 6/1964 | United Kingdom | 2/406 |

*Primary Examiner*—H. Hampton Hunter
*Attorney, Agent, or Firm*—Ladas & Parry

[57] ABSTRACT

A method for manufacturing a pair of briefs and briefs made according to the method. A blank in the shape of a bag is knitted by means of a circular knitting machine. In the blank there are cut two leg holes in the nature of straight cuts from the hip bone and inclined forwards towards a reinforced middle portion. The cuts are ended about 5 cm from each other.

6 Claims, 8 Drawing Figures

METHOD FOR MANUFACTURING A PAIR OF BRIEFS AND BRIEFS MANUFACTURED ACCORDING TO THE METHOD

The present invention relates to a method for manufacturing a pair of briefs and briefs manufactured according to the method.

It is previously known to manufacture strechtights and similar by means of a circular knitting machine, confer e.g. Swedish patent specification No. SE-7509171-0. Attempts have also been made to manufacture a pair of trousers and underpants with similar methods, but those attempts have not been successful. However, the Swedish patent specification No. SE-7405396-8 defines a method for manufacturing elastic briefs by means of a circular knitting machine, in which two separate portions are manufactured by means of the circular knitting machine and then sewn together. However, this necessary seam will be positioned so that it disturbs the comfort.

The only method up to now to manufactor a pair of trousers or underpants with a sufficient quality is to sew those articles of dress with a greater number of seams. However, this method is expensive.

The object of the present invention is to provide a method for manufacturing a pair of trousers or underpants, which makes it possible to manufacture those articles of dress by means of a circular knitting machine and some smaller method steps. The pair of trousers made according to the method has a comfort comparable with the above-mentioned sewn articles of dress, and the expence for manufacture is only a fraction of the cost for sewn articles of dress.

Thus, the starting-point for the present invention is to provide a pair of trousers knitted by means of a circular knitting machine, but which still will have the necessary comfort.

According to the present invention a method is provided for manufacturing a pair of trousers or similar articles of dress. According to the invention a bag-like blank is manufactured by means of the circular knitting machine. The blank has a reinforcement in its middle portion. Two leg holes are cut in the nature of straight lines, which extend from two almost diagonally positioned points, inclined forwards and downwards so that they essentially are tangents to said middle portion. The leg hole cuts are ended spaced from each other by about 4 to 8 cm. The borders around the leg holes and at the waist are provided with elastics sewn thereon.

The pair of briefs made according to the invention has shown completely to correspond to the requirements of comfort which can be put up, and are very cheap to manufacture.

In order to exemplify the invention, a preferred embodiment of the invention is described in details below by reference to the appended drawings.

FIG. 1 is a perspective view of a circular knitted blank for the pair of briefs according to the invention.

FIGS. 1*a, b* and *c* show different shapes of the reinforcement in the middle portion of the pair of briefs.

Figure 1:
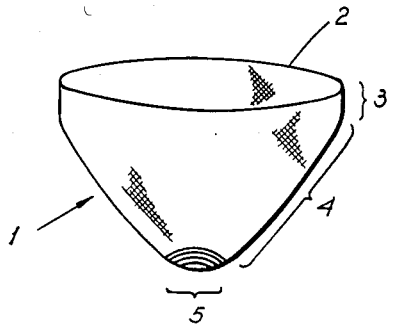

In FIG. 1 there is shown a blank for the pair of briefs according to the invention knitted on a circular knitting machine. It is previously known to manufacture a product with this appearance on a circular knitting machine, and thus, it is not described here. The blank 1 has the shape of a bag, having a open end facing upwards and surrounded by a border 2. The blank has a circumference corresponding to the waist circumference of the person who shall carry this article of dress. After this, the blank has an upper portion 3, which is essentially straight and can even be widening downwards. This upper portion passes over to an intermediate portion 4, which is softly narrowing to a considerably less circumference than the border 2. The intermediate portion 4 passes over to a lower portion 5, which is the lower termination of the bag-like blank. The portion 5 is almost circular seen from above. The portion 5 comprises a reinforcement, which is desired for a pair of briefs. It is also known technique to knit such a reinforcement with a circular knitting machine.

Figure 2:
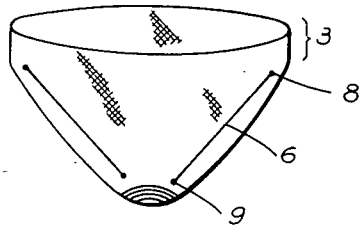
FIG. 2 shows the blank provided with leg cuts according to the invention.

In order to transform such a blank according to FIG. 1 to a pair of briefs with a high comfort, two leg holes 6 are cut according to FIG. 2. The leg hole 6 starts at the transition between the portions 3 and 4 at points, which are almost diagonally positioned in relation to each other. The leg cut 6 thus starts at the point 8 close to the side of the pair of briefs or somewhat forwards of the side. The leg cut extends therefrom inclined forwards so that it makes a tangent with the circular lower portion 5 and is ended immediately before the portion 5 in the point 9. Thus, the two points 9 of the two leg cuts will be positioned about 4 to 8 cm from each other and at the same height.

The leg cut should be essentially rectilinear in order achieve the advantageous comfort according to the invention. The leg cuts are cut separately by fixing the blank 1 by means of a suitable fixing device and the cut is made by a sharp knife or are eventually cut with a pair of scissors or is burned. The blank is thus placed on the fixing or supporting device, whereupon the knife makes the cut after a straight line. Since the blank 1 is completely rotationally symmetric it can be placed in the support in whatever direction as desired, which facilitates the automation of this step.

It is also possible to make both legcuts simultaneously by placing the blank carefully doubled, whereupon a knife cuts through the hole blank according to the line 6.

Finally, suitable elastics are sewn thereon around the leg cuts and around the waist. Eventually, it is possible to directly knit the elastics in the waist of the blank. It is possible to knit elastics around the cutting line 6 by means of an improved circular knitting machine and already at the knitting to prepare the cutting line 6 in the circular knitting machine by weaker portions.

It is very important that the cuts are cut very carefully and with exactly the right angle and length. The length and thus the size of the leg hole must of course be adapted so that the thigh will suit comfortably.

By the placing of the cuts 6, the right quantity of material of the blank will be distributed to the back side and the front side respectively of the pair of briefs so that it is correctly adapted to the shapes of the person. By the elasticity of the pair of briefs, it will adapt itself to the person with a smooth and equal stretching, which entails a very good comfort.

The cuts start from the hip bone and extends to the upper portion of the reinforcement between the legs. In this way, the reinforcement is placed where needed. At the same time, the middle line at the back side is lifted so that the pair of briefs suits rightly. The placement of the cuts thus controls how the pair of briefs will suit.

Figure 3:
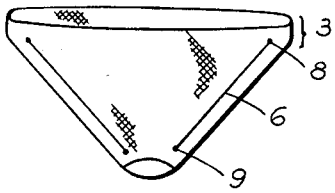
FIGS. 3 to 5 show different variants of the blank.
Figure 4:
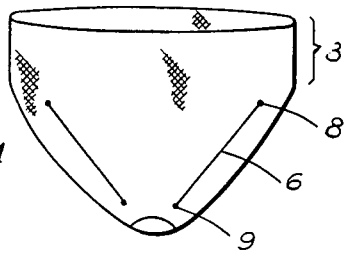
Figure 5:
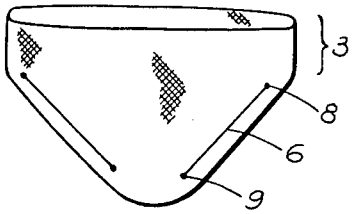

It is realised that the portion 3 can be shaped in dependence of the intended customer. For teen-age girls the portion can be very short while older ladies can have the portion 3 longer. In FIGS. 3 to 5 there is shown different usable shapes.

The blank 1 is knitted by a comparatively dense material having a certain elasticity so that the blank will have the required density and elasticity.

Figures 1A, 1B, 1C:
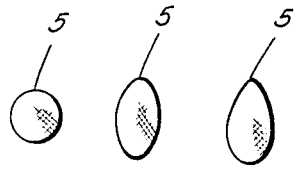

The reinforced portion 5 can also be shaped elliptically as is shown in FIGS. 1*a, b* and *c.*

It is also possible to make underpants by means of the method according to the invention. If so, a further cut is made for the fly at the front side. This cut can be covered with an overlapping portion, which is sewn thereon. Alternatively, the fly cut can be cut up to the waist border, whereupon the two portions are placed over each other and sewn together a short portion downwards from the waist.

The embodiments described above are only intended for elucidating the invention and do not limit the invention. A person skilled in the art realise that many modifications are possible within the scope of the invention as defined in the appended patent claims. The invention is only limited by the appended patent claims.

What I claim is:

1. A method of manufacturing a pair of briefs by means of a circular knitting machine, comprising the steps of:

(a) knitting a blank in the shape of a bag having an upper essentially cylindric portion, an intermediate narrowing portion and a lower, essentially circular end portion; and (b) cutting two leg hole cuts in said intermediate portion without removing any material, said cuts being straight lines positioned on a front side of the pair of briefs and extending essentially rectilinear from a lower point and upward and outward to an upper point essentially along a side edge of the blank, the lower point and the upper point being spaced a short distance inwardly of said side edge of the blank.

2. A method as claimed in claim 1, further comprising the step of providing the leg hole cuts and a waist opening with elastics.

3. A method as claimed in claim 1, wherein the cuts are made by double folding the blank along a plane comprising front and back middle vertical lines of the blank and cutting the two cuts in one operation by cutting through both parts of the blank.

4. A pair of briefs comprising:

(a) a circular knit blank in the shape of a bag having an upper essentially cylindric portion, an intermediate narrowing portion and a lower, essentially circular end portion;

(b) said intermediate portion having two leg hole cuts, which have been cut without removing any material of the blank, said cuts being straight lines positioned on a front side of the pair of briefs and extending essentially rectilinear from a lower point and upwards and outwards to an upper point essentially along a side edge of the blank, the lower point and the upper point being spaced a short distance inwardly of said side edge of the blank.

5. A pair of briefs according to claim 4, wherein the distance between the lower points of the two leg hole cuts is about 5 cm.

6. A pair of briefs according to claim 4, wherein the lower essentially circular portion is somewhat elliptical.

* * * * *